US005455978A

United States Patent [19]

Graham

[11] Patent Number: 5,455,978

[45] Date of Patent: Oct. 10, 1995

[54] SPONGE MOP WITH MOP HEAD CONNECTOR REQUIRING NO EXTERNAL FASTENERS

[75] Inventor: John W. Graham, Greenville, S.C.

[73] Assignee: Southern Technologies, Inc., Greenville, S.C.

[21] Appl. No.: 184,020

[22] Filed: Jan. 21, 1994

[51] Int. Cl.[6] ..... A47L 13/144

[52] U.S. Cl. ..... 15/119.2; 15/244.1

[58] Field of Search ..... 15/147.1, 171, 15/177, 116.2, 119.2, 228, 244.1, 148; 403/335

[56] References Cited

U.S. PATENT DOCUMENTS

| | | | |
|---|---|---|---|
| 236,077 | 12/1880 | Peirce . | |
| 374,171 | 12/1887 | Bourke | 15/148 |
| 1,072,173 | 9/1913 | Schlafly . | |
| 1,113,740 | 10/1914 | Beebe et al. | 15/177 |
| 1,138,934 | 5/1915 | Cook | 15/171 |
| 1,191,758 | 7/1916 | Beebe et al. | 15/177 |
| 1,191,975 | 7/1916 | Kenoyer | 15/177 |
| 1,814,201 | 7/1931 | Wingard | 15/171 |
| 2,852,794 | 9/1958 | Blum | 15/119.2 |
| 2,864,115 | 12/1958 | Champlin | 15/177 |
| 2,941,226 | 6/1960 | Kautenberg | 15/119.2 |
| 3,434,176 | 3/1969 | Cazet | 15/147.1 |
| 4,196,488 | 4/1980 | Barry | 15/119.2 |
| 4,324,016 | 4/1982 | Herbig | 15/119.2 |
| 4,491,998 | 1/1985 | Wilson et al. | 15/119.2 |
| 4,604,767 | 8/1986 | Burkhart et al. | 15/119.2 |

FOREIGN PATENT DOCUMENTS

| | | | |
|---|---|---|---|
| 21654 | 1/1956 | Germany | 15/119.2 |
| 149119 | 11/1931 | Switzerland | 15/244.1 |

*Primary Examiner*—Mark Spisich
*Attorney, Agent, or Firm*—Bell, Seltzer, Park & Gibson

[57] ABSTRACT

A mop head connector for a wringer type sponge mop includes a pair of substantially identical shell halves, each shell half having a face and opposing sidewalls extending from the face. The sidewalls of the respective shell halves are positioned in cooperating contact to form the assembled mop head connector. At least one protruding tab portion, a first type of preferred latch member, is provided on a sidewall of each shell half. At least one groove portion, a second type of preferred latch member, is provided on an opposite sidewall of each shell half. The groove portions are positioned to receive respective protruding tab portions on the opposing shell half to hold the shell halves in assembled relation without the use of external mechanical fasteners. The interlocking latch members are crimped together to permanently retain the shell halves in an assembled relation. In addition, an end portion of an elongate handle is positioned within mop head connector. An outwardly flared segment on the handle end portion secures the elongate handle within the mop head connector without the use of external mechanical fasteners.

26 Claims, 3 Drawing Sheets

11
10
18
17
19
28
13
12
14
20
16
15
24

24
16
26

34
5
4
28
25
30
33
14c
20
29
14a
14b
32
31
13c
13a
13b

SPONGE MOP WITH MOP HEAD CONNECTOR REQUIRING NO EXTERNAL FASTENERS

FIELD OF THE INVENTION

This invention relates generally to wringer type sponge mops, and more particularly, to a mop head connector.

BACKGROUND OF THE INVENTION

Most wringer mops include a two piece mop head connector which holds an elongate handle at one end and a sponge head at the other end. Typical mop head connectors require threaded nuts, bolts, screws, or other fasteners to secure the connector together as well as to secure the connector onto the mop handle. Along with such typical fastening techniques come a variety of manufacturing and assembly disadvantages. For example, holes need to be punched to receive screws, which in turn requires additional steps in the process for assembly. Also, more parts are required, the screws and bolts may easily rust, corrode, or otherwise need replacement, etc. Thus, the common external mechanical fastener is very often a weak link in the structural integrity of a sponge mop.

In addition, the finished connector has its own drawbacks. For example, U.S. Pat. No. 4,196,488 discloses a wringer sponge mop with a mop housing composed of two symmetrical shell halves which are held together by fastening rivets. The top of the mop head connector has squared edges, which could nick or tear furniture if the mop comes into contact with surfaces which are readily damaged. The fastening rivets provide additional edges on which fabric may be torn or finishes nicked. If a fastener becomes loose, the mop may simply fall apart.

Similarly, U.S. Pat. Nos. 4,491,998 and 4,604,767 also disclose wringer mops which use complimentary shell halves to form a mop connector and hold an elongate handle at one end and a cleaning sponge at the other end. The shell halves are joined together using conventional external mechanical fasteners, and the mops thus suffer the same limitations and shortcomings as listed above.

SUMMARY OF THE INVENTION

With the foregoing in mind, it is an object of the present invention to provide a mop head connector for a wringer type sponge mop which overcomes many of the disadvantages of the mops presently available.

These and other objects according to the present invention are provided by a wringer type sponge mop which includes an elongate handle and a sponge head connected together by a mop head connector formed of two complimentary shell halves which are interlocked together without the use of external mechanical fasteners. The mop head connector has a first end which is preferably in the form of a tubular handle receiving formation and is connected to the elongate handle. A second end of the mop head connector preferably has a rectangular sponge head receiving formation and is connected to the sponge head.

The mop head connector includes a pair of shell halves, which may be substantially identical, each shell half having a face and opposing sidewalls extending from the face. The sidewalls of the respective shell halves are positioned in cooperating contact to form the assembled mop head connector. Each shell half may have a relatively narrow semicircular formation at its first end, which cooperates with a like semicircular formation of the opposing shell half to form the tubular handle receiving portion. In addition, each shell half may also have a relatively wider second end having a pair of outwardly extending posts which cooperates with a like pair of outwardly extending posts of the opposing shell half to define four corners of an imaginary rectangle to thereby form the rectangular sponge head receiving formation. The sidewalls preferably extend continuously in opposing relation along opposite sides of the face from the relatively narrow semicircular formation to the relatively wider second end. Each shell half may also include an outwardly flared portion located between the relatively narrow semicircular formation and the relatively wider second end to provide a smooth transition therebetween.

A latch member in the form of a protruding tab portion is provided on the relatively narrow semicircular formation and on the relatively wider second end on a sidewall of each shell half. A cooperating latch member in the form of a groove portion is provided on the relatively narrow semicircular formation and on the relatively wider second end on an opposite sidewall of each shell half. The groove portions are positioned to receive respective protruding tab portions on the opposing shell half to hold the shell halves in assembled relation without the use of external mechanical fasteners. The interlocking latch members are crimped together to permanently retain the shell halves in an assembled relation. Accordingly, the latch members of one shell half interlock with the latch members of the other shell half to hold the shell halves in assembled relation.

The elongate handle preferably includes a hollow end portion positioned within the tubular handle receiving formation for securing the handle within the mop head connector without the use of external mechanical fasteners. An outwardly flared portion on the handle end portion located within and cooperating with the tubular handle receiving portion may be used to retain the elongate handle within the tubular handle receiving formation.

A method of making the mop head connector according to the invention includes the steps of providing a pair of shell halves as described above; assembling the shell halves in cooperating contacting relation such that the latch members of one shell half interlock with the latch members of the other shell half; and crimping the interlocking latch members to hold the shell halves in assembled relation without the use of external mechanical fasteners. The crimping step is preferably an internal crimping of each protruding tab portion between a respective groove portion. After assembling the pair of shell halves, which have a tubular handle receiving formation at one end, a hollow end portion of an elongate handle may be inserted into the tubular handle receiving formation. A segment of the end portion within the mop head connector may then be expanded so that a bulge is formed for securing the elongate handle within the mop head connector.

BRIEF DESCRIPTION OF THE DRAWINGS

Other objects and advantages will appear as the description proceeds when taken in connection with the accompanying drawings, in which.

DESCRIPTION OF PREFERRED EMBODIMENTS

The present invention will be described more fully hereinafter with reference to the accompanying drawings in which a preferred embodiment of the invention is shown. This invention may, however, be embodied in different forms and should not be construed as limited to the embodiments set forth herein; rather this embodiment is provided so that this disclosure will be thorough and complete, and will fully convey the scope of the invention to those skilled in the art.

Figures 1, 2, 3:
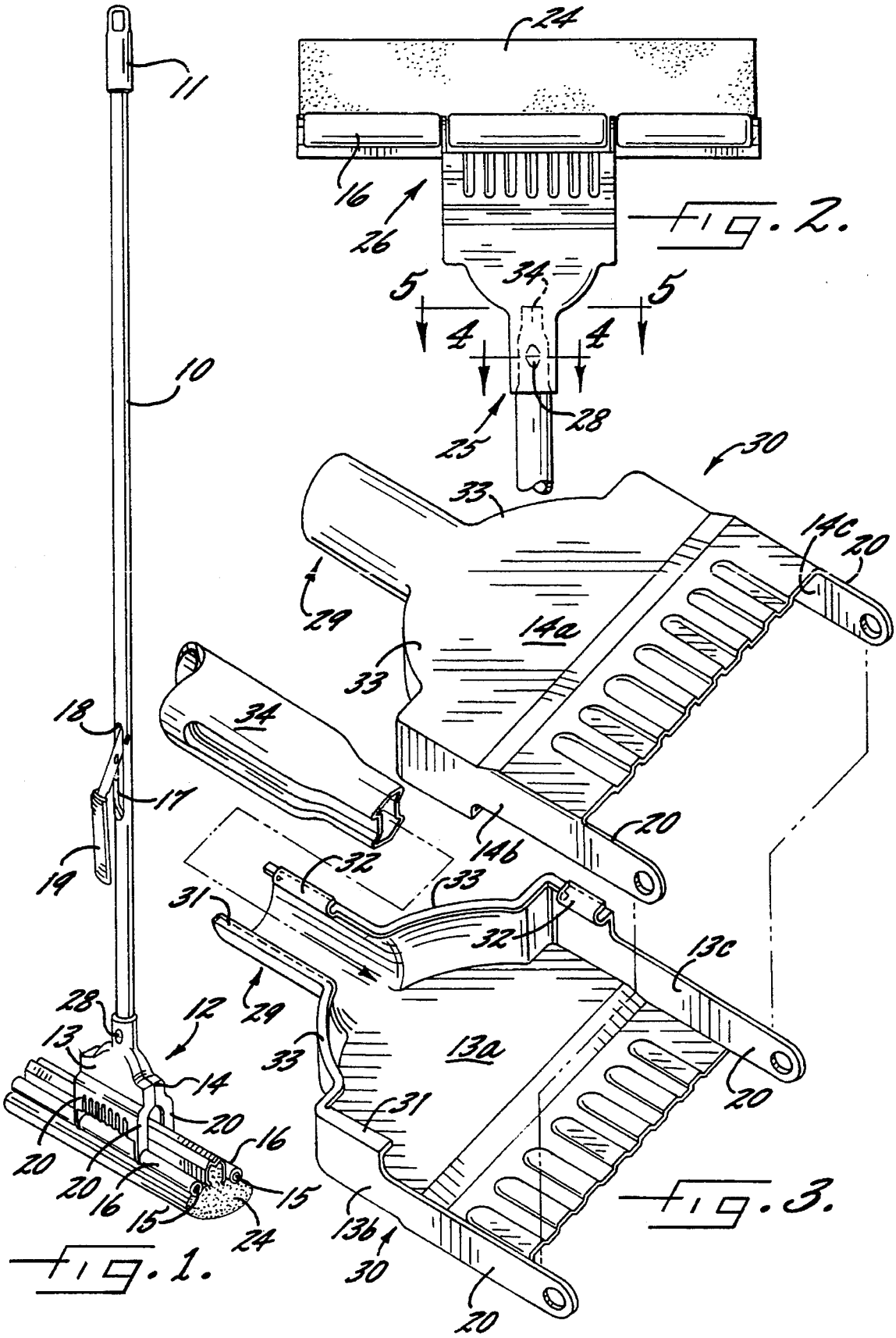
FIG. 1 is a perspective view of a wringer type sponge mop with a mop head connector of the present invention associated therewith.
FIG. 2 is an elevational view of a lower end of the mop shown in FIG. 1 and illustrates the mop head connector and an elongate handle therein.
FIG. 3 is an exploded view of a pair of complimentary shell halves which make up the inventive mop head connector and a hollow end portion of the elongate handle associated therewith.
Figure 4:
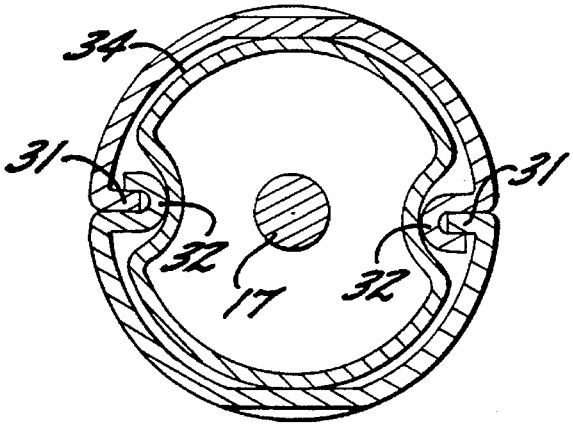
FIG. 4 is a cross-sectional view along the line 4—4 of FIG. 2 and illustrates latch members of the mop head connector and the elongate handle.

A wringer mop, as shown in FIG. 1, generally includes an elongate handle 10, in the form of a hollow tube, with a suitable closure element 11 fixed at one end, which may include an opening for hanging the mop on a nail or a hook. A mop head connector, broadly indicated at 12, is fixed on the other end of the handle 10 for retaining a cleaning sponge 24 and a wringer mechanism. The mop head connector 12 is formed of two shell halves 13, 14 of stamped sheet metal which are interlockingly connected together as described more fully below. The connector has legs 20 extending from one end in the form of outwardly extending posts. The support legs 20 carry the wringer mechanism, including a pair of roller support shafts 15 on which a pair of opposing rollers 16 are supported. The opposing rollers 16 extend in parallel spaced apart relation and receive the sponge head 24 therebetween.

An operating rod 17 extends upwardly through the handle 10 and has an upper end bent outwardly at an angle through a slot 18 along a medial portion of the handle 10. An operating lever 19 is pivotally connected at its inner end to the handle 10. The upper end of the operating rod 17 is pivotally connected to a medial portion of the operating lever 19. The operating lever 19 can impart longitudinal inward and outward movement to the operating rod 17. Thus, the position of a cleaning sponge 24 is controlled by the movement of the operating lever 19. When the operating lever 19 is moved upwardly from the position shown in FIG. 1, the cleaning sponge 24 is drawn inwardly between the opposing rollers 16 so that any liquid in the cleaning sponge 24 is squeezed therefrom. When the operating lever 19 is moved back to the position shown in FIG. 1, the cleaning sponge 24 is moved outwardly between the pair of opposing rollers 16 to the cleaning position shown in FIG. 1. When the operating lever 19 is moved downwardly from the position shown in FIG. 1, the cleaning sponge 24 is moved beyond the opposing rollers 16 to a position which facilitates the removal or replacement of the cleaning sponge 24.

Referring now more particularly to the mop head connector 12, one end of the connector 12 has a tubular handle receiving formation 25, which is connected to the elongate handle 10, as shown in FIG. 2. The second end of the mop head connector 12 preferably takes the form of a rectangular sponge head receiving formation 26. The connector 12 is formed from two complimentary shell halves 13, 14, which, as shown in FIG. 3, are preferably of identical construction. Each shell half 13, 14 has a face 13*a*, 14*a* and opposing side walls 13*b*, 13*c* and 14*b*, 14*c* extending from their respective faces 13*a*, 14*a*. The side walls of the respective shell halves 13, 14 are positioned in cooperating contact to form the assembled mop head connector 12. Each shell half has a relatively narrow semicircular formation 29 at its first end which cooperates with a like semicircular formation 29 of the opposing shell half to form the tubular handle receiving portion 25. Each shell half also has a relatively wider second end 30 having a pair of outwardly extending posts 20, which cooperates with a like pair of outwardly extending posts 20 of the opposing shell half to define four corners of an imaginary rectangle to thereby form the rectangular sponge head receiving formation 26.

Latch members 31, 32 are provided on the sidewalls of each shell half and are so located and configured that the latch members of one shell half 13 interlock with the latch members of the other shell half 14 to hold the shell halves in assembled relation without the use of external mechanical fasteners. A first latch member is preferably a protruding tab portion 31 provided on a sidewall of each shell half 13, 14. A second latch member is preferably a groove portion 32 provided on an opposite sidewall of each shell half 13, 14 and positioned to receive the protruding tab portion 31 on the opposing shell half. The cooperating latch members 31, 32 are crimped to hold the two shell halves 13, 14 securely together. Of course, many other geometric variations would be suitable as interlocking latch members, as would be understood by those skilled in the art.

Figure 7:
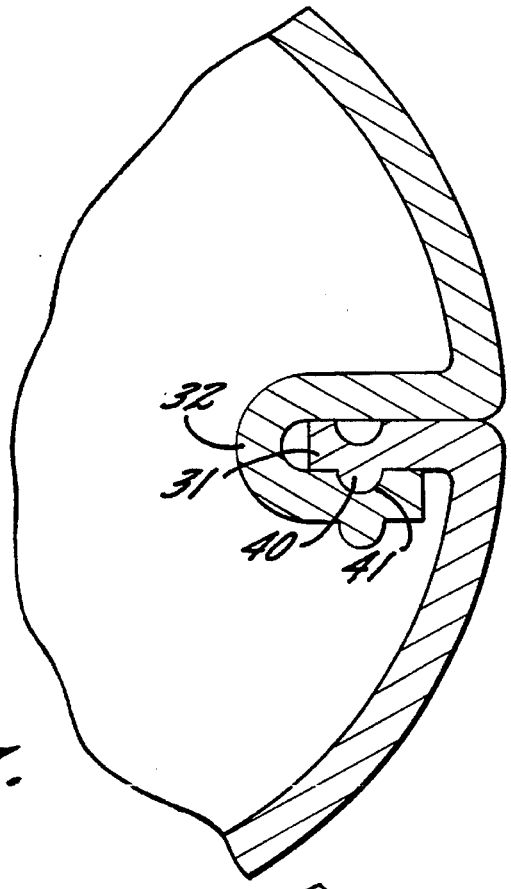
FIG. 7 is a greatly enlarged view of latch members according to the invention with an additional securing technique.

In some circumstances, it may be desirable to provide additional securement for the interlocking latch members 31, 32 to insure a long sponge mop life. Accordingly, the interlocking latch members 31, 32 may include a dimple 40 on one latch member and a recess 41 for receiving the dimple 40 on the adjacent latch member, as shown in FIG. 7. Thus, at least one of the protruding tab portion 31 and the groove portion 32 may include a dimple 40, and at least one of the other of the protruding tab portion 31 and the groove portion 32 may include a recess 41 adjacent the dimple 40 for receiving the dimple 40. Of course, multiple dimples 40 along with multiple cooperating recesses 41 may be used. To facilitate manufacturing, the recess 41 may take the form of a channel, along which a dimple 40 may be secured.

Figure 8:
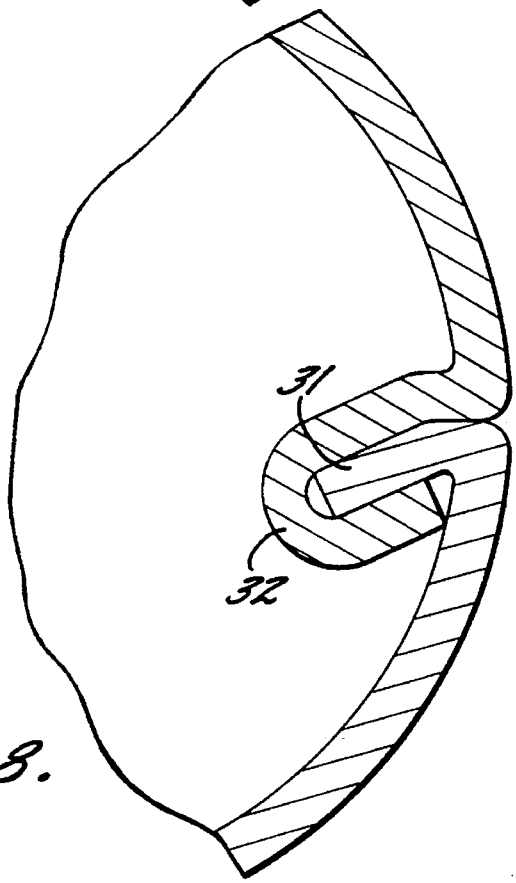
FIG. 8 is another greatly enlarged view of latch members according to the invention with an alternative securing bend.

An alternative securing procedure, as shown in FIG. 8, does not require a dimple 40 or recess 41. Instead, the interlocking latch members 31, 32 are warped or bent to further secure the shell halves. By warping the combination of each protruding tab portion 31 within each groove portion 32 the shell halves may be more securely locked in place. Another possibility is a spot weld (not shown) located on either side of the finished mop head connector 12, for example, at a point where the two shell halves 13, 14 meet near the outwardly extending posts 20.

In the illustrated embodiment, a protruding tab portion 31 is provided both on the relatively narrow semicircular formation 29 and on the relatively wider second end 30 on a sidewall 13*b*, 14*c* of each shell half. Similarly, a channel or groove portion 32 is provided both on the relatively narrow semicircular formation 29 and on the relatively wider second end 30 on an opposite sidewall 13*c*, 14*c* of each shell half. The groove portions 32 are positioned to receive respective protruding tab portions 31 on the opposing shell half to hold the shell halves 13, 14 in assembled relation without the use of external mechanical fasteners.

The sidewalls 13*b*, 13*c* and 14*b*, 14*c* preferably extend continuously in opposing relation along opposite sides of their respective faces 13*a*, 14*a* from the relatively narrow semicircular formation 29 to the relatively wider second end 30. Each shell half may include an outwardly flared portion 33 located between the relatively narrow semicircular formation 29 and the relatively wider second end 30 to provide a smooth transition therebetween. In addition, the sidewalls of each shell half may be turned inwardly at their edges so as to provide a clean and smooth exterior.

Figure 5:
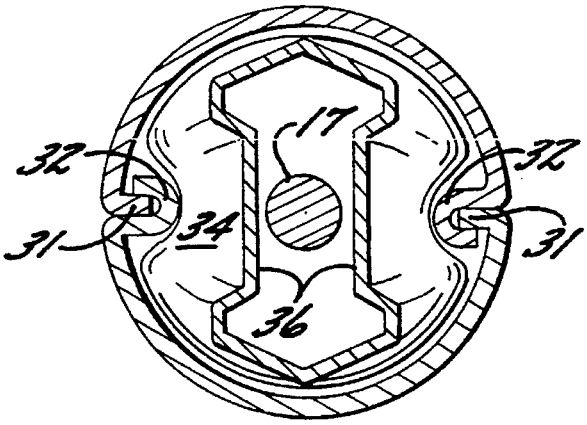
FIG. 5 is a cross-sectional view along the line 5—5 of FIG. 2 before the hollow end portion of the elongate handle is flared.
Figure 6:
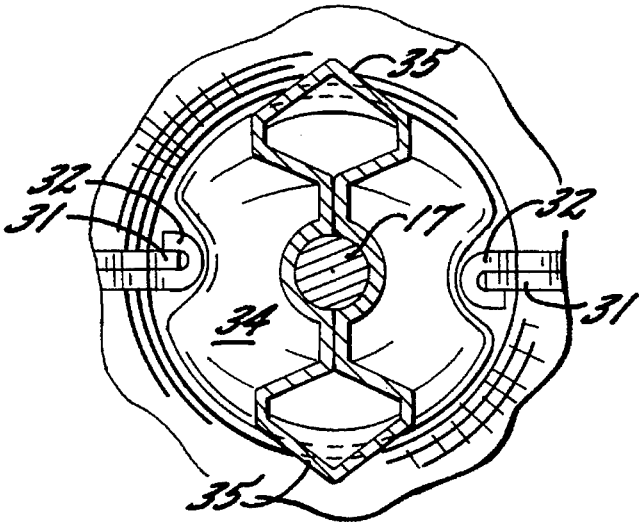
FIG. 6 is similar to FIG. 5 but wherein the elongate handle is flared to secure it within the mop head connector.

The elongate handle 10 includes an end portion 34 positioned within the tubular handle receiving formation 25. A preferred way of securing the elongate handle 10 within the handle receiving formation 25 is to mechanically expand the end portion 34 so that a bulge 35 forms to frictionally secure the mop handle 10 in the mop head connector 12. The end portion 34 is shown prior to expansion in FIG. 5. By crimping a medial section 36 of the end portion 34, an outer periphery of the end portion 34 bulges to mechanically lock the elongate handle 10 inside and against the inner walls the mop head connector 12, as shown in FIG. 6. Additional securing techniques may include crimping the exterior of the tubular handle receiving formation 25 after it is secured onto the elongate handle 10. A crimp of this type would be visible as a dimple 28, as illustrated in FIGS. 1 and 2. Those skilled in the art would recognize that other methods may be used to yield the same frictional lock. By inserting the operating rod 17 into its position through the hollow end portion 34 prior to crimping the medial section 36, the operating rod 17 may be slidably secured during the crimping operation. The operating rod 17 will thus be held in proper position for removal and replacement of the cleaning sponge 24.

Accordingly, a preferred method of making a mop head connector 12 according to the invention includes the steps of providing a pair of shell halves 13, 14 as described above; assembling the shell halves 13, 14 in cooperating contacting relation such that the latch members 31, 32 of one shell half 13 interlock with the latch members 31, 32 of the other shell half 14; and crimping the interlocking latch members to hold the shell halves 13, 14 in assembled relation without the use of external mechanical fasteners. The step of providing latch members 31, 32 for each sidewall may optionally include forming a dimple 40 on one of the protruding tab portion 31 and the groove portion 32 and forming a recess 41 on the other of the protruding tab portion 31 and the groove portion 32 for receiving the dimple 40. The step of crimping preferably involves internally crimping each protruding tab portion 31 between a respective groove portion 32. The method may further encompass the step of warping the crimped groove and protruding tab portions to further secure the shell halves 13, 14.

With a tubular handle receiving formation 25 at one end, a hollow end portion 34 of an elongate handle 10 may be inserted into the tubular handle receiving formation 25. A segment of the end portion 34 of the elongate handle 10 within the mop head connector 12 may then be expanded to form a bulge 35 to frictionally secure the elongate handle 10 within the mop head connector 12. The cleaning sponge connector of the present invention thus requires no bolts and nuts or other extraneous connection means and is simply and easily manufactured.

One skilled in the art would readily appreciate that other forms of the invention can be incorporated into wringer type sponge mops. Accordingly, many modifications and other embodiments of the invention will come to the mind of one skilled in the art having the benefit of the teachings presented in the foregoing descriptions and the associated drawings. The drawings and specification set forth the best mode presently contemplated for the practice of the present invention, and although specific terms are employed, they are used in a generic and descriptive sense only and not for purposes of limitation. Therefore, it is to be understood that the invention is not to be limited to the particular embodiment disclosed, and that modifications and other embodiments are intended to be included within the scope of the appended claims.

That which is claimed:

1. A sponge mop comprising:

an elongate handle;

a sponge head; and a mop head connector having a first end connected to said elongate handle and a second end connected to said sponge head, said second end of said mop head connector including a rectangular sponge head receiving formation, said mop head connector comprising:

a pair of substantially identical shell halves, each shell half having a face and first and second opposing sidewalls extending from said face, the first sidewall of each respective shell half being positioned in cooperating contact with the second sidewall of the other shell half to form the assembled mop head connector; and wherein each shell half includes a pair of outwardly extending posts at its second end which cooperates with a like pair of outwardly extending posts of the opposing shell half to define four corners of an imaginary rectangle to thereby form said rectangular sponge head receiving formation, and a first latch member provided on the first sidewall of each of said shell halves and a second latch member provided on the second sidewall of each of said shell halves, wherein said first latch members have a different configuration from said second latch members, the first latch member of each shell half interlocking with the second latch member of the other shell half to hold the shell halves in assembled relation without the use of external mechanical fasteners.

2. A sponge mop according to claim 1 wherein said first latch members comprise a protruding tab portion provided on the first sidewall of each shell half.

3. A sponge mop according to claim 2 wherein said second latch members further comprise a groove portion provided on the second sidewall of each shell half, the groove portion being positioned to receive the protruding tab portion on the opposing shell half.

4. A sponge mop according to claim 1 wherein said first end of said mop head connector includes a tubular handle receiving formation.

5. A sponge mop according to claim 4 wherein said elongate handle includes an end portion positioned within said tubular handle receiving formation and including means for securing said elongate handle within said handle receiving formation without the use of external mechanical fasteners.

6. A sponge mop according to claim 4 wherein each of said shell halves includes a relatively narrow semicircular formation at said first end which cooperates with a like semicircular formation of the opposing shell half to form said tubular handle receiving formation, and said second end is relatively wider than said first end.

7. A sponge mop according to claim 6 wherein said sidewalls extend continuously in opposing relation along opposite sides of said face from said relatively narrow semicircular formation to said relatively wider second end.

8. A sponge mop according to claim 7 wherein each of said shell halves includes an outwardly flared portion located between said relatively narrow semicircular formation and said relatively wider second end and providing a smooth transition therebetween.

9. A sponge mop according to claim 1 wherein said interlocking latch members are crimped together to permanently retain said shell halves in assembled relation.

10. A sponge mop according to claim 9 wherein the interlocking latch members include a dimple on one latch member and a recess for receiving said dimple on the adjacent latch member to further secure the interlocking latch members.

11. A sponge mop according to claim 9 wherein the interlocking latch members are warped to further secure the shell halves.

12. A sponge mop comprising:

an elongate handle;

a sponge head; and a mop head connector having a first end in the form of a tubular handle receiving formation connected to said elongate handle and a second end in the form of a rectangular sponge head receiving formation connected to said sponge head, said mop head connector comprising:

a pair of substantially identical shell halves, each shell half having a face and opposing sidewalls extending from said face, the sidewalls of the respective shell halves being positioned in cooperating contact to form the assembled mop head connector, each of said shell halves having a relatively narrow semicircular formation at said first end which cooperates with a like semicircular formation of the opposing shell half to form said tubular handle receiving formation and a relatively wider second end having a pair of outwardly extending posts which cooperates with a like pair of outwardly extending poses of the opposing shell half to define four corners of an imaginary rectangle to thereby form said rectangular sponge head receiving formation;

a protruding tab portion provided on the relatively narrow semicircular formation and a protruding tab portion provided on the relatively wider second end on a sidewall of each shell half;

a groove portion provided on the relatively narrow semicircular formation and a groove portion provided on the relatively wider second end on a sidewall of each shell half; the groove portions being positioned to receive respective protruding tab portions on the opposing shell half to hold the shell halves in assembled relation without the use of external mechanical fasteners.

13. A sponge mop according to claim 12 wherein each of said shell halves includes an outwardly flared portion located between said relatively narrow semicircular formation and said relatively wider second end and providing a smooth transition therebetween.

14. A sponge mop according to claim 12 wherein said elongate handle includes an end portion positioned within said tubular handle receiving formation and including means for securing said elongate handle within said handle receiving formation without the use of external mechanical fasteners.

15. A sponge mop according to claim 12 wherein mating protruding tab and groove portions are crimped together to permanently retain the shell halves in assembled relation.

16. A sponge mop according to claim 15 wherein one of the protruding tab portion and the groove portion includes a dimple, and wherein the other of the protruding tab portion and the groove portion includes a recess adjacent said dimple for receiving said dimple to further secure the interlocking latch members.

17. A sponge mop according to claim 15 wherein each groove and respective protruding tab portions are warped to further secure the shell halves.

18. A mop head connector comprising:

a pair of substantially identical shell halves, each shell half having a first end and a second end, a face, and opposing first and second sidewalls extending from said face, the second end of each shell half being relatively wider than the first end, and the first sidewall of each respective shell half being positioned in cooperating contact with the second sidewall of the other shell half to form the assembled mop head connector; and first latch members provided on the first sidewall of each of said shell halves, and second latch members provided on the Second sidewall of each of said shell halves, wherein said first latch members have a different configuration from said second latch members, the latch members of one shell half interlocking with the latch members of the other shell half to hold the shell halves in assembled relation without the use of external mechanical fasteners.

19. A connector according to claim 18 wherein said first latch members comprise a protruding tab portion provided on the first sidewall of each shell half.

20. A connector according to claim 19 wherein said second latch members further comprise a groove portion provided on the second sidewall of each shell half, the groove portion being positioned to receive the protruding tab portion on the opposing shell half.

21. A connector according to claim 18 wherein said first end includes a tubular handle receiving formation.

22. A connector according to claim 21 wherein each of said shell halves includes a relatively narrow semicircular formation at said first end which cooperates with a like semicircular formation of the opposing shell half to form said tubular handle receiving formation and wherein said second end of each of said shell halves has a pair of outwardly extending posts which cooperates with a like pair of outwardly extending posts of the opposing shell half to define four corners of an imaginary rectangle to thereby form a rectangular sponge head receiving formation.

23. A connector according to claim 22 wherein said sidewalls extend continuously in opposing relation along opposite sides of said face from said relatively narrow semicircular formation to said relatively wider second end.

24. A connector according to claim 23 wherein each of said shell halves includes an outwardly flared portion located between said relatively narrow semicircular formation and said relatively wider second end and providing a smooth transition therebetween.

25. A connector according to claim 18 wherein said interlocking latch members are crimped together to permanently retain said shell halves in assembled relation.

26. A sponge mop comprising:

an elongate handle;

a sponge head; and a mop head connector having a first end connected to said elongate handle and a second end connected to said sponge head, said mop head connector comprising:

a pair of shell halves, each shell half having a face and opposing sidewalls extending from said face, the sidewalls of the respective shell halves being positioned in cooperating contact to form the assembled mop head connector; and latch members provided on the sidewalls of each of said shell halves, the latch members of one shell half interlocking with the latch members of the other shell half to hold the shell halves in assembled relation without the use of external mechanical fasteners, wherein said first end of said mop head connector includes a tubular handle receiving formation and said second end of said mop head connector includes a rectangular sponge head receiving formation and said elongate handle includes an end portion positioned within said tubular handle receiving formation and including means for securing said elongate handle within said handle receiving formation without the use of external mechanical fasteners and wherein said means for securing said elongate handle within said tubular handle receiving formation comprises an outwardly flared mechanically expanded bulge on said handle end portion located within and surrounded by said tubular handle receiving formation, said bulge frictionally engaging the surrounding handle receiving formation to retain said elongate handle within said tubular handle receiving formation.

* * * * *

UNITED STATES PATENT AND TRADEMARK OFFICE

CERTIFICATE OF CORRECTION

PATENT NO. : 5,455,978

DATED : October 10, 1995

INVENTOR(S) : Graham

It is certified that error appears in the above-identified patent and that said Letters Patent is hereby corrected as shown below:

Column 7, line 44, "poses" should be --posts--.

Column 8, line 28, "Second" should be --second--.

Signed and Sealed this

Twenty-third Day of January, 1996

*Attest:*

*Attesting Officer*

BRUCE LEHMAN

*Commissioner of Patents and Trademarks*